US008992127B2

(12) United States Patent
Joensen et al.

(10) Patent No.: US 8,992,127 B2
(45) Date of Patent: Mar. 31, 2015

(54) METHOD AND APPARATUS FOR SUBSEA INSTALLATIONS

(75) Inventors: Arnbjorn Joensen, Aberdeen (GB); Samuel David Irvine Paul, Aberdeen (GB)

(73) Assignee: Subsea Deployment Systems Limited (GB)

( * ) Notice: Subject to any disclaimer, the term of this patent is extended or adjusted under 35 U.S.C. 154(b) by 732 days.

(21) Appl. No.: 13/061,691

(22) PCT Filed: Oct. 15, 2009

(86) PCT No.: PCT/GB2009/051383
§ 371 (c)(1), (2), (4) Date: Mar. 1, 2011

(87) PCT Pub. No.: WO2010/046686
PCT Pub. Date: Apr. 29, 2010

(65) Prior Publication Data

US 2011/0164926 A1 Jul. 7, 2011

(30) Foreign Application Priority Data

Oct. 24, 2008 (GB) ..... 0819489.6

(51) Int. Cl.

| | |
|---|---|
| ***E02D 23/02*** | (2006.01) |
| ***E21B 19/00*** | (2006.01) |
| ***B63B 27/00*** | (2006.01) |
| ***B63C 11/00*** | (2006.01) |
| ***E21B 41/00*** | (2006.01) |
| ***E21B 41/04*** | (2006.01) |

(52) U.S. Cl.
CPC ..... *E21B 19/002* (2013.01); *B63B 27/00* (2013.01); *B63C 11/00* (2013.01); *E21B 41/0007* (2013.01); *E21B 41/04* (2013.01)
USPC ..... 405/205

(58) Field of Classification Search
USPC ..... 405/205, 224.2–224.4; 114/230.1, 114/230.22; 166/350, 355, 367, 351, 338, 166/341
See application file for complete search history.

(56) References Cited

U.S. PATENT DOCUMENTS

| | | | | |
|---|---|---|---|---|
| 4,126,298 | A * | 11/1978 | Lub | 254/277 |
| 4,828,430 | A | 5/1989 | van der Heyden | |
| 5,069,580 | A | 12/1991 | Herwig et al. | |

(Continued)

FOREIGN PATENT DOCUMENTS

| | | |
|---|---|---|
| BR | PI0502113-8 A | 1/2007 |
| GB | 1576957 | 10/1980 |

(Continued)

*Primary Examiner* — Tara M. Pinnock
(74) *Attorney, Agent, or Firm* — Workman Nydegger

(57) ABSTRACT

There is provided a method and apparatus for lowering and/or raising a load or structure to or from the bed of a body of water. The apparatus comprises a buoyancy apparatus configured to be coupled to a load, and having positive buoyancy sufficient to lift the load. At least one receptacle is provided on the apparatus for receiving a control weight lowered from a vessel to lower or raise the assembly. The lowering method includes forming an assembly from a buoyancy apparatus and a load and submerging the assembly to a position at a first height above the bed. In a preferred embodiment the assembly is submerged by a clump weight tow system. A control weight is deployed from a vessel to the assembly to overcome the positive buoyancy of the assembly and thereby lower the load from the first height to the bed. The raising method reverses the steps of the lowering method.

21 Claims, 11 Drawing Sheets

(56) References Cited

U.S. PATENT DOCUMENTS

| | | | | |
|---|---|---|---|---|
| 5,190,107 | A | 3/1993 | Langner et al. | |
| 5,215,410 | A | 6/1993 | Karal | |
| 5,240,446 | A | 8/1993 | Boatman et al. | |
| 5,354,151 | A | 10/1994 | Giannesini | |
| 6,106,198 | A | 8/2000 | Børseth | |
| 6,837,311 | B1 | 1/2005 | Sele et al. | |
| 7,311,469 | B2 | 12/2007 | Pollack et al. | |
| 7,416,025 | B2 * | 8/2008 | Bhat et al. | 166/355 |
| 2002/0141829 | A1 | 10/2002 | Choi et al. | |
| 2003/0221602 | A1 | 12/2003 | Guinn et al. | |
| 2005/0152748 | A1 | 7/2005 | Tangen et al. | |
| 2005/0169714 | A1 | 8/2005 | Marchant et al. | |
| 2007/0048093 | A1 | 3/2007 | Bhat et al. | |

FOREIGN PATENT DOCUMENTS

| | | | |
|---|---|---|---|
| GB | 2291090 | A | 1/1996 |
| WO | 2006000919 | A1 | 1/2006 |
| WO | 2006125791 | A1 | 11/2006 |
| WO | 2009063159 | A1 | 5/2009 |
| WO | 2009070034 | A2 | 6/2009 |
| WO | 2010032027 | A2 | 3/2010 |

* cited by examiner

FIG. 9A
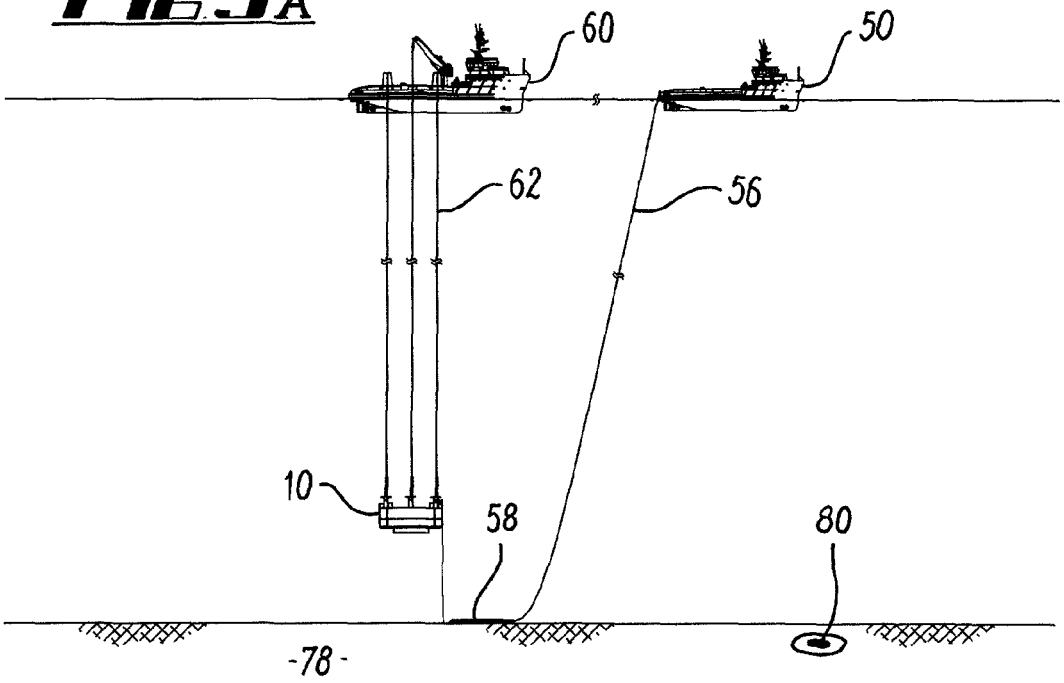
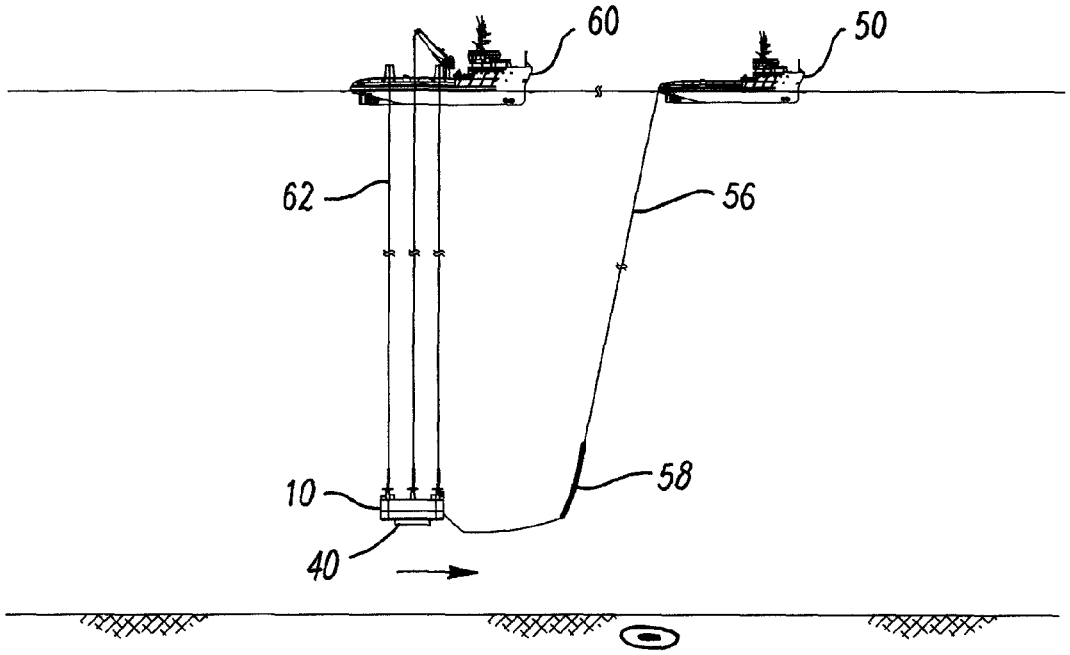
FIG. 9B

METHOD AND APPARATUS FOR SUBSEA INSTALLATIONS

The present invention relates to methods and apparatus for use in the installation of structures or loads on to the bed of a body of water. Aspects of the invention relate to a method and apparatus for lowering a load to the bed of a body of water. Other aspects of the invention relate to a method of recovering a load from the bed of a body of water.

BACKGROUND TO THE INVENTION

Industries such as the offshore oil and gas exploration and production industry or the marine renewable energy industry require subsea infrastructure and facilities to support the offshore operations, including for example manifolds, trees, riser arches, seabed foundations and pipelines. One example of an item of infrastructure is a subsea manifold, which provides an interface between pipelines and wells at the seabed. A manifold may be designed to handle flow of produced hydrocarbons from multiple wells and direct the flow to several production flow lines. A typical manifold will comprise flow meters, control systems and electrical and hydraulic components. The manifold supports and protects the pipelines and valve system, and also provides a support platform for remotely operated vehicle (ROV) operations. Manifolds and other items of infrastructure have a significant weight and size which introduce complications to the installation process.

Manifolds and other items of subsea infrastructure are manufactured onshore and transported to an installation site by a marine vessel. A conventional method of installation involves transportation of the load on the deck of a vessel until it is in the vicinity of the installation site. The load is then lifted from the deck of the vessel by a crane and lowered to the body of water until it is suspended. The load will then be maneuvered into its desired location by a marine vessel, before the load is landed on the seabed in its designated position.

Such an installation method has a number of drawbacks. For example, the weight and size of the load is inherently limited by the capacity and reach of the crane. In addition, where installation is required in deep water, the weight of the crane wire contributes significantly to the load on the crane, which reduces the effective crane capacity. Although the effects of crane wire weight can be eliminated by using weight neutral crane wires, these have the disadvantage that they contribute to the complexity of the operation and may add to the duration of the installation process. During the lifting process, dynamic and hydrodynamic loading on the vessel can be significant, which also requires a reduction in the effective crane capacity.

This type of installation method also exposes the apparatus being lifted to wave slamming as the load passes through the splash zone and water surface. Many items of subsea infrastructure comprise sensitive equipment which may be exposed to risk of damage from wave action. In addition, weather limitations may be imposed to avoid exposure of the load to large accelerating or decelerating forces during pick-up or landing on the seabed or deck of a vessel which may cause damage to the equipment. To address this, many cranes are provided with active heave compensation systems that will allow the soft landing of loads, but such active heave compensation systems can be deficient when used in deep water operations.

A heavy lift vessel (HLV) may be used to overcome some of the difficulties described above to install large and/or heavy payloads. However, an HLV requires multi-reeved crane blocks with slow hoisting and lowering speeds. The payloads are lowered or lifted very slowly, which increases the time during which the equipment is exposed to risk of damage at or near the water surface.

The problems described above are affected by sea state, with adverse environmental conditions further reducing the crane capacity and the time in which the marine vessel is able to work. Increasing sea state also increases the risk of damage to the load. Failure of the lifting system is potentially catastrophic to the load and may endanger the marine vessel and/or its crew.

To alleviate the drawbacks of the described installation method, suspended tow systems have been devised. In a direct suspension system, the load is lifted and lowered into the body of water and suspended directly below the transportation vessel. The suspension system is provided with means for resisting the full hydrodynamic loading associated with the vessel and wave motion. A direct suspension system has many of the limitations of the conventional surface transportation described above, but has the advantage that the in air lift and lowering through the water surface can be done near shore in sheltered waters. This reduces the dynamic loads and therefore may be performed with reduced crane capacity. In addition, the point from which the load is suspended is usually close to mid-ships, and is therefore subject to lower dynamics due to the pitch and roll of the vessel. However, the operation remains highly weather sensitive, due to the suspension of the load directly beneath the vessel throughout the transportation phase. The process also has the disadvantage that the additional inshore lift suspension operation is required.

A W-suspension method is an alternative to the conventional installation and direct suspension methods described above. A W-suspension method provides buoyancy tanks on the payload such that it is slightly positively buoyant. The load is connected fore and aft to tug vessels via tow lines, and is launched by towing the load at the surface until there is sufficient draught. Clump weights are then added to the tow wires to cause the structure to submerge below the surface. The depth of the structure below the surface is controlled by the length and tension of the tow lines. The load is then towed to the vicinity of the installation site, and the tow lines can be paid out until the clump weights come to rest on the seabed. Final landing of the load is achieved by flooding the buoyancy tanks to overcome the positive buoyancy.

The W-suspension method has the advantage that the need for a crane vessel is avoided, and the transition through the water surface may be performed near shore in sheltered water. Because the structure is towed in a submerged position, the transportation phase is less weather sensitive. In addition, hydrodynamic loading on the structure is reduced due to the coupling of the structure to the vessels via clump weight tow wires. GB 1576957 relates to a W-suspension system for submerging and raising a buoyant object by the deployment of clump weight chains from vessels. The chains are fixed to the corners of the load and are attached to jibs on vessels.

However, the W-suspension method has the disadvantage that it requires buoyancy tanks, which must be integral with the payload or temporally coupled to it. Where integral buoyancy tanks are provided, the structure becomes larger and heavier. Where temporary buoyancy tanks are provided, they will need to be recovered subsequent to the operation. The buoyancy tanks are subject to hydrostatic loading which limits the depth to which the method can be used. The lateral position of the structure during final lowering can be difficult to control via the clump weights, particularly in areas with strong currents. The position of the two tug vessels needs to be carefully controlled. Finally, in the W-suspension system, failure of the buoyancy tanks is catastrophic to the load.

WO 06/125791 discloses an installation system which uses a positively buoyant submerged installation vessel. A J-shaped catenary chain controls the buoyancy and depth of the installation vessel in a similar manner to a W-suspension system. The load is lowered to the seabed by paying out a line from a winch system in the vessel. The requirement for a winch is a disadvantage, as it adds to the weight and complexity of the vessel. The system also relies on buoyancy tanks. Failure of the winch system or buoyancy tanks is catastrophic to the operation.

US 2003/221602 discloses an alternative installation system, which is based in part on the W-suspension system described above. A clump weight chain is used to adjust the vertical position of a load which is suspended by buoyancy tanks. The load is suspended to a depth beneath the buoys which is greater than the distant between the buoy and the centre of the clump weight. This allows lowering of the clump weight to the seabed to ensure landing of the load. This system suffers from the drawback that the length between the buoyancy and the bottom of the load must exceed that of the clump weight if the load is to be landed. This also means that there is no provision for parking the system; the load must be lowered on to the seabed if the operation is to be interrupted. U.S. Pat. No. 5,190,107 discloses a similar system, which includes provision for anchoring the system to the seabed using a separate clump weight.

A further alternative system for lowering large structures on to the seabed is described in U.S. Pat. No. 4,828,430. The load is lifted from the vessel by a crane and lowered through the surface of the water. The load has an integral buoyancy tank which provides a small positive buoyancy. The load is lowered from surface and to the seabed by overcoming the buoyancy using a weight lowered from the crane on to the load. However, the arrangement of U.S. Pat. No. 4,828,430 relies on an integral buoyancy tank in the load, which adds to the size and weight. The installation method also requires a crane for the initial lift phase from the deck of the vessel to the body of the water, and is subject to the limitations of the conventional surface transport method described above.

It is one aim of the invention to provide a method and apparatus which overcomes or alleviates at least one drawback of each of the systems described above.

Additional aims and objects of the invention will become apparent from reading the following description.

SUMMARY OF THE INVENTION

According to a first aspect of the invention, there is provided a method of lowering a load to a bed of a body of water, the method comprising:

Forming an assembly from a buoyancy apparatus and a payload, wherein the buoyancy apparatus renders the assembly positively buoyant;

Submerging the assembly to a position at a first height above the bed;

Deploying a control weight from a vessel to the assembly to overcome the positive buoyancy of the assembly and thereby lower the payload from the first height to the bed.

The method may comprise submerging the assembly to the first height above the bed using a clump weight line, which may be by controlled deployment of the clump weight line from a surface vessel, for example a tug. The method may comprise parking the assembly at the first height above the seabed, such that the assembly may be safely left if the operation is interrupted. Subsequently the control weight, which is preferably in the form of a control chain, may be coupled to the assembly at the first height above the bed.

In this context, coupling or coupled means a physical interaction between two components, but does not necessarily imply a physical positive attachment or engagement. In the described embodiments, coupling is achieved by location of a control weight in a receptacle. Receptacle in this context means a formation which is capable of receiving and/or retaining at least a portion of a control weight in a manner that allows the control weight and the apparatus to interact. Chain will be understood to encapsulate a system of linked objects such as articulated weights.

The method may comprise supporting a first portion of the control chain on a lower surface of the receptacle, and may comprise suspending a second portion of the control chain above the first portion within the receptacle. A third portion of the control chain may be suspended between the control vessel and an opening to the receptacle.

The method may further comprise ballasting the assembly with a ballast weight, which may correspond to the weight of the payload of the assembly, prior to detaching the payload. The control weight may be recovered from the buoyancy apparatus to raise the apparatus from the bed.

The ballast weight may comprise one or more discrete weights, or alternatively may comprise a fluid or slurry taken on by the assembly.

The method of the first aspect and its embodiments, or certain selected steps thereof, may be reversed. A second aspect of the invention therefore relates to a method of raising a payload from a bed of a body of water, the method comprising:

Providing an assembly on a bed formed from a buoyancy apparatus and the load, wherein the buoyancy apparatus has sufficient buoyancy to lift the payload;

Retaining the assembly on the bed using a control weight;

Using a vessel to retrieve the control weight from the assembly to render the assembly positively buoyant, thereby raising the assembly from the bed.

The methods may comprise adding or removing a ballast weight from the assembly. For example, ballast may be added with an equivalent weight to that of the payload, such that the apparatus without the payload (i.e. after release or before forming an assembly) has a positive buoyancy sufficient buoyancy to lift the apparatus and ballast. Alternatively ballast may be removed or decoupled from the assembly of the apparatus and the payload such that the assembly reverts to a positive buoyancy sufficient to lift the payload.

The method may comprise decoupling a ballast weight from the assembly subsequent to forming the assembly.

According to a third aspect of the invention there is provided an apparatus for lowering or raising a load to or from a bed of a body of water, the apparatus comprising: a buoyancy apparatus configured to be coupled to a payload, the buoyancy apparatus having positive buoyancy sufficient to lift the load; and at least one receptacle for receiving a control weight lowered from a vessel to lower or raise the assembly.

The apparatus may comprise a clump weight line. The control weight may be a control chain, and the receptacle may comprise a lower surface for supporting a first portion of the control chain. Preferably the receptacle is configured for suspension of a second portion of the control chain above the first portion within the receptacle. This facilitates lateral control of the apparatus in a submerged state. The receptacle may comprise an elongate tower oriented substantially vertically on the buoyancy apparatus.

The apparatus may comprise a ballast chamber for retaining a ballast weight on the apparatus, which may be a chain locker for receiving a ballast weight from a surface vessel. Alternatively, the apparatus may be configured to take on and/or release ballast from the seabed, or to receive ballast pumped from and/or to surface or flooded from or discharged to the body of water.

Preferably the apparatus comprises solid buoyancy, which may be in the form of a plurality of solid buoyancy modules. Preferably the solid buoyancy is sufficient to render the apparatus and a payload marginally buoyant. Alternative embodiments may include buoyancy tanks.

According to a fourth aspect of the invention there is provided an assembly used in an installation or deployment method in a body of water, the assembly comprising a payload to be conveyed to or from a bed of the body of water and a buoyancy apparatus coupled to the load, the buoyancy apparatus rendering the assembly positively buoyant; and at least one receptacle for receiving a control weight lowered from a vessel to lower or raise the assembly.

The buoyancy apparatus of the fourth aspect of the invention may comprise the apparatus of the third aspect of the invention or its embodiments According to a fifth aspect of the invention, there is provided an installation system comprising the assembly of the fourth aspect of the invention and a control vessel for deploying a control weight to the assembly.

The control weight may comprise a control chain and may be operable to be coupled to the assembly. The installation system may further comprise a towing vessel for the assembly and a towing clump weight.

In a sixth aspect of the invention the payload may be in the form of a structure with integral buoyancy, in which case the invention extends to a method of lowering a structure to a bed of a body of water, the method comprising:

Submerging a structure to a position at a first height above the bed, the structure comprising a buoyancy apparatus which gives the structure positive buoyancy;

Deploying a control weight from a vessel to the structure to overcome the positive buoyancy of the structure and thereby lower the structure from the first height to the bed.

Where the buoyancy is integral with the structure, a seventh aspect of the invention extends to a method of raising a structure from a bed of a body of water, the method comprising:

Providing a structure on the bed, the structure comprising the load, a buoyancy apparatus with positive buoyancy sufficient to lift the load, and a control weight sufficient to maintain the structure on the bed;

Using a vessel to retrieve the control weight from the structure to render the structure positively buoyant, thereby raising the structure to a first height above the bed.

The method may include the step of deballasting the structure to render it positively buoyant.

Preferred and optional aspects of the sixth or seventh aspects of the invention may comprise features of the first or second aspects of the invention or their preferred embodiments.

According to an eighth aspect of the invention there is provided a receptacle for receiving a control chain for use in a method of lowering or raising a payload in a body of water, the receptacle comprising: an internal volume for receiving and retaining a portion of a control chain; an opening to the receptacle configured for passage of the control chain into or from the receptacle; a lower surface for supporting at least a first portion of the control chain in use; wherein the opening is spatially separated from the lower surface to allow a second portion of the control chain to be suspended in the receptacle between the first portion and the opening.

Preferably, the receptacle is configured to resist removal of the control chain from the receptacle. The receptacle may comprise a restricted neck portion. The receptacle may be shaped to promote friction between an inner surface of the receptacle and a control chain within the receptacle.

The receptacle may be configured to be disposed on a subsea apparatus, which may be the apparatus of the third aspect of the invention, or a structure or payload to be lowered or raised to or from the seabed. Preferred and optional aspects of the eighth aspect of the invention may comprise features of the third aspect of the invention or its preferred embodiments.

BRIEF DESCRIPTION OF THE DRAWINGS

There will now be described, by way of example only, various embodiments of the invention with reference to the drawings, of which:

FIGS. 9A, 9B and 9C are schematic side views of different stages of a load repositioning and landing operation in accordance with an embodiment of the invention;

DETAILED DESCRIPTION

Figure 1B:
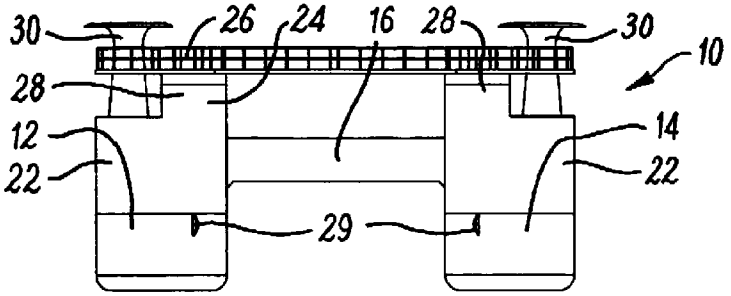
FIGS. 1A, 1B, 1C and 1D are respectively side, forward end, plan and perspective views of an apparatus in accordance with a first embodiment of the invention.
Figure 1D:
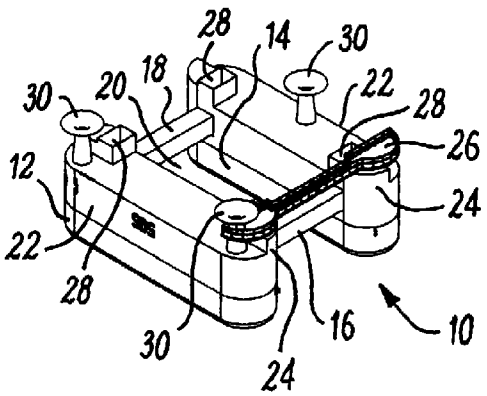
Figure 1A:
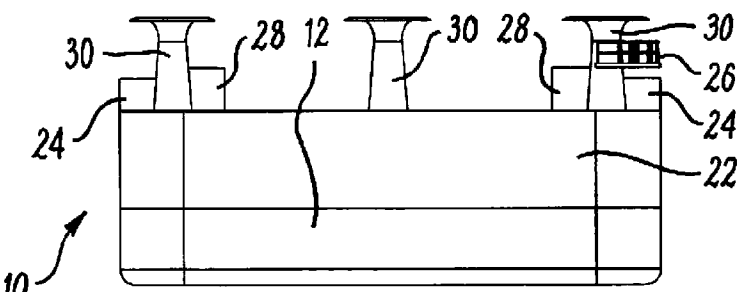
Figure 1C:
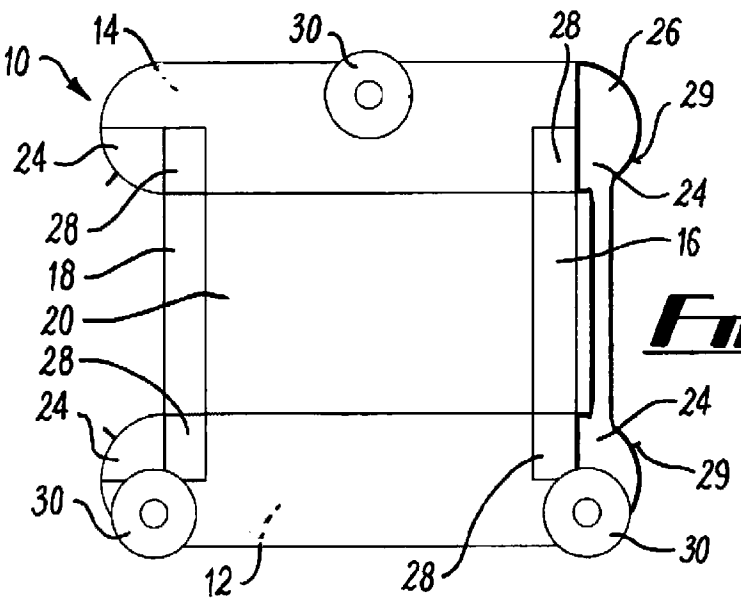

Referring firstly to FIGS. 1A to 1D, there is shown an apparatus 10 used in an installation operation for lowering or raising a payload or structure to or from the bed of a body of water. In the examples described, the invention is applied to a marine environment in which the load is lowered or and/or raised from the seabed. It will be appreciated that the invention also has application to freshwater environments.

The apparatus 10 comprises two hulls or pontoons 12 and 14, which are of a size and shape suitable for providing enough buoyancy for transportation of the apparatus with shallow draught. The hulls 12, 14 are linked together by one forward transverse bridging member 16 and one aft transverse bridging member 18, which maintain the hulls in a fixed spatial relationship and provide a load bearing structure for a payload (not shown). A space 20 is defined between the hulls. The spacing between the hulls 12, 14 is selected to accommodate a payload or structure to be lowered to or raised from the seabed. Typical payloads or structures include manifolds, trees, riser arches, seabed foundations and other items of subsea infrastructure.

Each hull 12, 14 allows complete flooding during submerged transport to prevent collapse of the hull structure. The hulls are divided into tank compartments to allow control of the list and trim of the apparatus 10 during surface transport. Each compartment of the hull is fitted with safety check valves to provide a further safeguard against structural damage.

The upper part of each hull 12, 14 comprises a frame 22 which defines a volume in which solid buoyancy modules (not shown) are located. Suitable solid buoyancy modules are known in the art, and include for example syntactic foam. Preferably the solid buoyancy modules will have a high compressive strength which enables them to retain their structure under high hydrostatic forces experienced at significant depths. Multiple solid buoyancy modules are located within the frame 22 and combine to create a large volume of buoyancy. Individual buoyancy modules may be repaired and/or replaced if they become damaged during operations. The buoyancy provided by the buoyancy modules is sufficient to render an assembly consisting of the whole apparatus 10, complete with payload and with fully flooded hull compartments marginally buoyant. In addition, the buoyancy is sufficient to render such an assembly neutrally buoyant when a predetermined amount of tow chain is coupled to the assembly (as will be described in more detail below). The frame 22 retains the buoyancy modules within the upper part of each hull. The frame 22 has multiple apertures (not shown) which allow the internal volume defined by the frame to be flooded when submerged and drained during surfacing. Providing multiple apertures also has the advantage that the volume of steel used in the apparatus is reduced, which decreases the overall weight. The sizing of the hulls and the positioning of the solid buoyancy will ensure that the meta centre or centre of buoyancy is above the centre of gravity of the apparatus with or without the payload.

The frames 22 are provided with castles 24, integrally formed with the frames 22. A castle 24 is located at each opposing end of each hull (i.e. fore and aft of each hull). The castles are filled with solid buoyancy modules, and provide surplus buoyancy prior to the apparatus being submerged. The castles provide a small water plane area at each corner and allow fine trimming of the buoyancy. A work platform 26 is located at the fore end of the apparatus, and extends across the space between the hulls 12 and 14. The work platform 26 allows personnel to attend the vessel when it is floating above the waterline. The work platform 26 comprises a ballasting manifold for the hull compartments and the castles and valve access for personnel attending the work platform.

The fore and aft ends of each hull 12, 14 are provided with chain lockers 28 upstanding from the base line of the hull. Each chain locker 28 is open to an upward direction from the apparatus 10 and free flooding from below. One function of the chain lockers 28 is to allow trimming of the apparatus 10 by accommodating lengths of ballast chain (not shown). The combined volume of the chain lockers 28 is sufficient to accommodate enough chain to overcome the surplus buoyancy of the apparatus. In this embodiment, the chain lockers 28 have sufficient combined volume to accommodate enough chain to equal or exceed the weight heaviest payload which may be lowered or raised using the apparatus 10. The footprint of each chain locker 28 is as large as is practical, so that the ballast chain rests as low as possible in the locker. This ensures that the centre of gravity remains low and improves the stability of the apparatus. Each trimming chain locker may be subdivided so that units of chain can be readily recovered and added as required for the operation.

Each hull 12, 14 is provided at its fore and aft ends with a towing pad eye 29 to enable the connection of a towing bridle. The towing bridle is connected to a tug boat via a towing pennant, as will be described below.

Figure 2A:
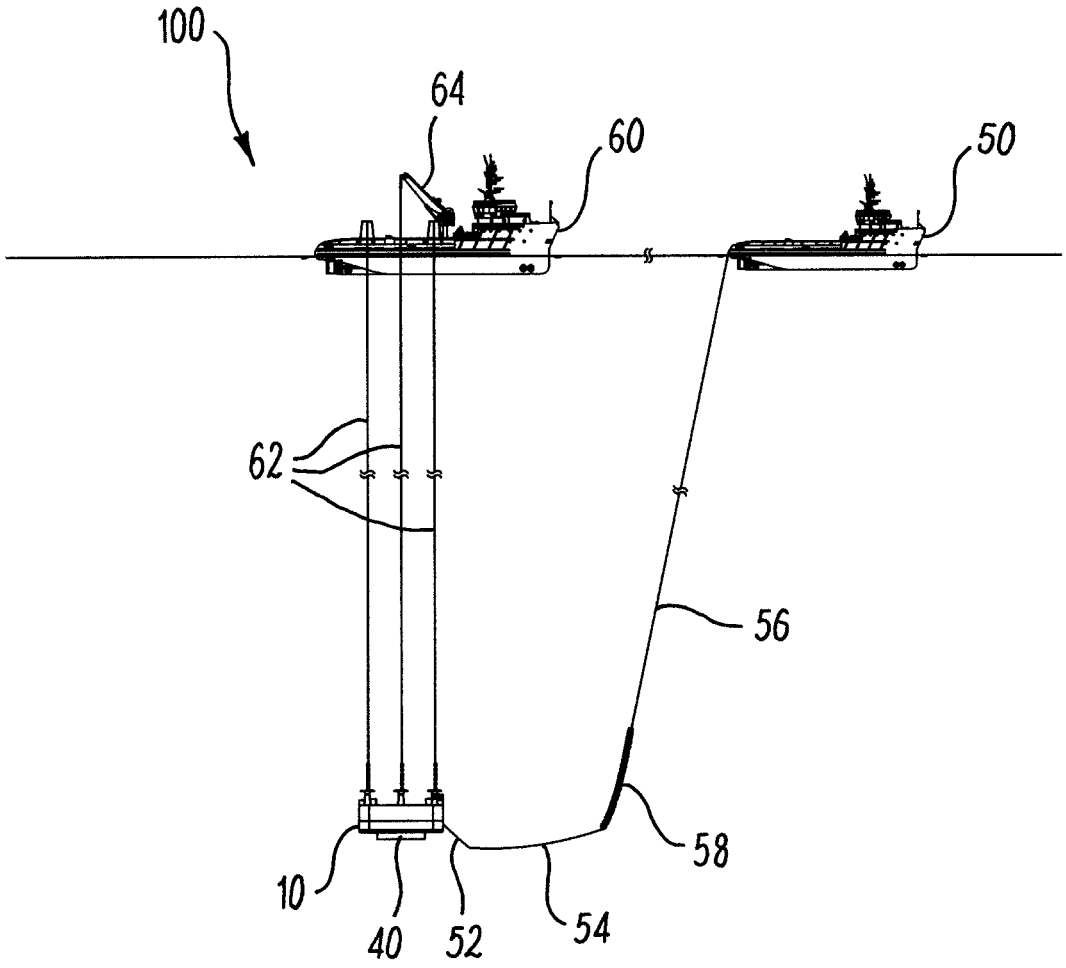
FIG. 2A is a schematic view showing the apparatus of FIG. 1 as part of an installation system in accordance with an embodiment of the invention.
Figure 2B:
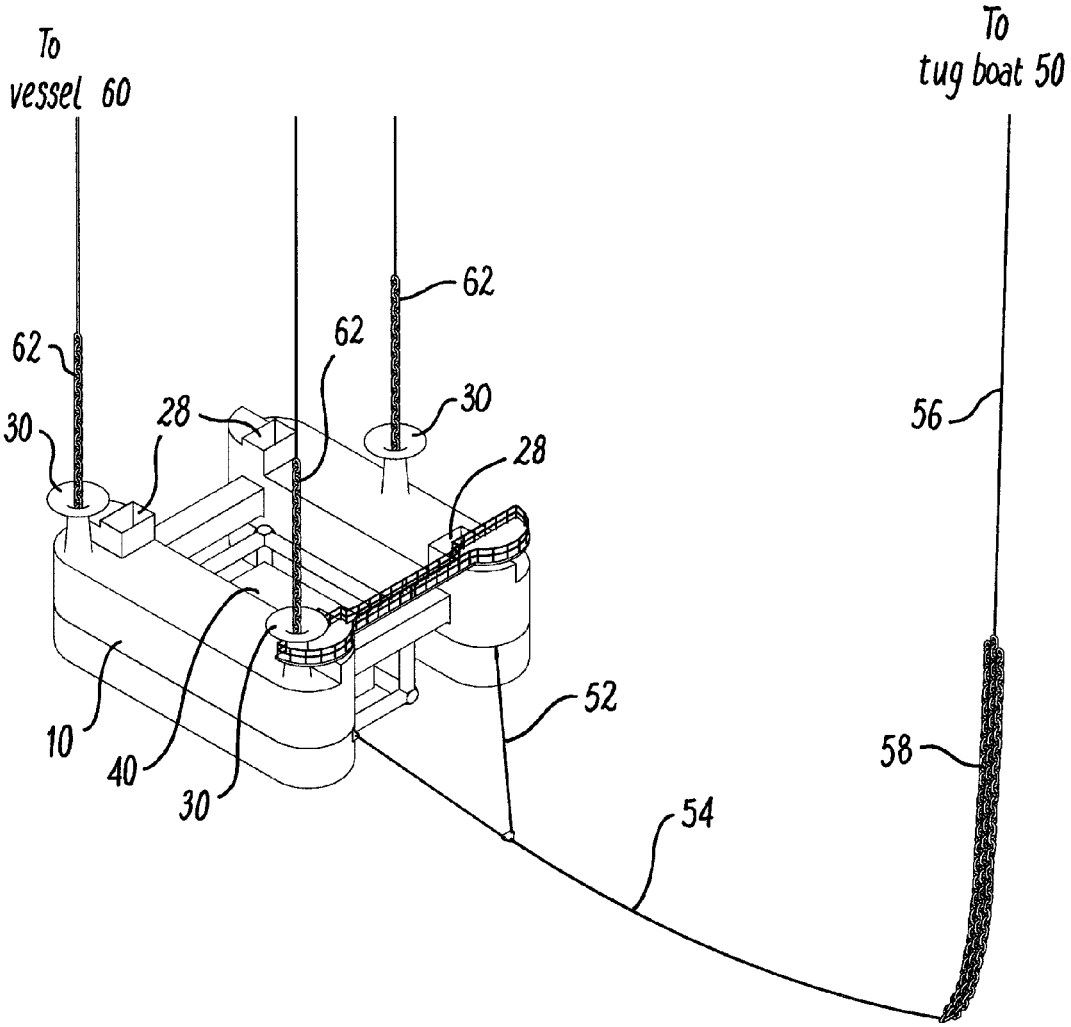
FIG. 2B is a perspective view of a part of the installation system on FIG. 2A in accordance with an embodiment of the invention.

The apparatus also comprises receptacles in the form of control chain towers 30, the function of which can be understood with reference to FIGS. 2A and 2B. FIG. 2A is a schematic side view of a subsea installation system 100. FIG. 2B shows the submerged components of the system 100 in perspective view. The system 100 comprises an assembly consisting of the apparatus 10 and a payload 40, a tug boat 50, and a control vessel 60. The payload 40 is suspended from the apparatus via an interface (not shown) The tug boat 50 is coupled to the apparatus 10 via a tow system which comprises the tow bridle 52, a towing pennant 54 and a tug boat tow wire 56. A clump weight, which in this embodiment is formed from a towing chain clump weight 58, is connected between the tow line and the towing pennant. The towing chain clump weight 58 functions to allow submerged towing of the apparatus 10 and to provide a means for anchoring the apparatus 10 at the seabed, as will be described below. The chain clump weight 58 may be of any suitable size or length, and in this example is a bundled chain. The chain clump weight 58 is heavy enough to neutralise the surplus buoyancy of the apparatus, and comprises surplus weight to provide resistance to currents acting on the apparatus 10 when anchored on the seabed.

The control vessel 60 comprises means for deploying a control weight from the vessel 60 to the apparatus 10. In this embodiment, the control weight consists of three weighted control chains 62 which are lowered from the control vessel using a crane 64 or winches. Each control chain 62 is configured to be received in the control chain towers 30 of the apparatus 10.

Figure 3A:
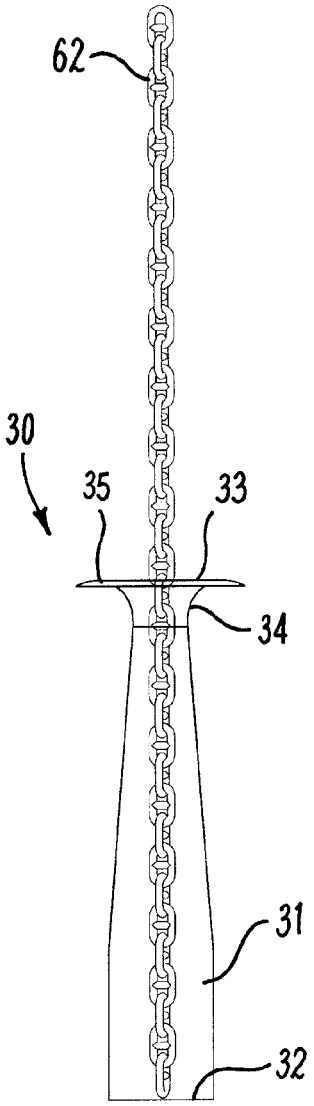
FIGS. 3A, 3B and 3C are schematic side views of control chain towers forming a part of the apparatus of FIG. 1 in accordance with an embodiment of the invention.
Figure 3B:
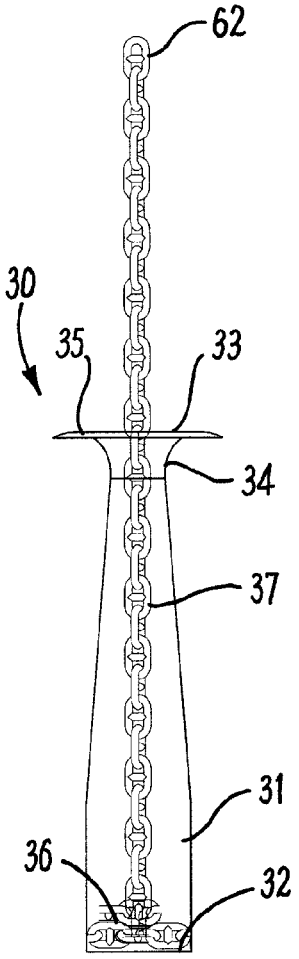
Figure 3C:
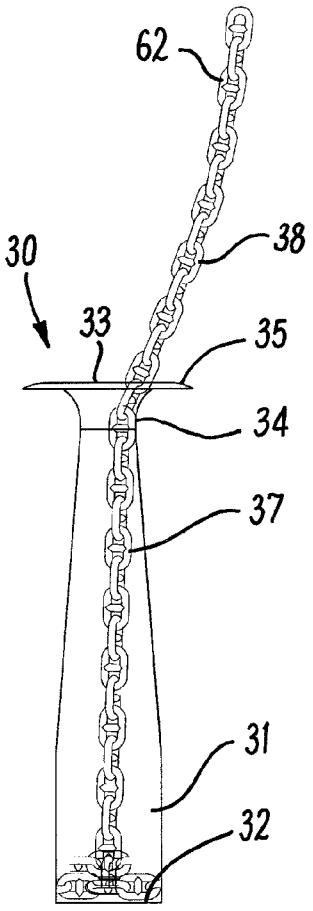

The control chain towers may be understood with reference to FIGS. 3A to 3C. The control chain towers 30 are built upwards from the base line of the hulls 12, 14, and extend beyond the vertical height of the frame 22. Each control chain tower comprises a fully free flooding chain locker 31. The chain locker has an internal volume shaped to accommodate the chain 62, a base 32 defining a lower surface to the support at least a portion of the chain 62, and an aperture 33 open to an upward direction of the apparatus 10. The aperture 33 to the control chain tower 30 defines a restricted neck portion 34 of the tower 30. A flared end 35 defines a funnel which increases the target area for a chain 62 lowered from the vessel 60.

In this embodiment, three control chain towers 30 are provided, with one located at each of the fore and aft ends of the hull 12, and one located substantially equidistant from the fore and aft ends of the hull 14. The three control chain towers are located on the apparatus spaced at the furthest distant possible. In this embodiment, the control chain towers are located in the form of an equilateral triangle, although other configurations may be used. The sum of the volumes of the control chain towers 30 is sufficient to accommodate enough chain to counter the surplus buoyancy of the apparatus 10 and payload 40.

The internal shape of the chain tower 30 is configured such that it resists removal of the chain from the chain tower. In other words, the resistance to removal of the chain from the tower is greater than the resistance to the lowering of the control chain into the chain tower under its own weight. In the described embodiment, this is achieved by shaping the chain tower with a restriction at its neck which creates an increased frictional force between the chain tower and the chain to resist separation of the two components.

In use, the control chain 62 is deployed from the vessel 60, and received in the control chain tower 30. In the condition shown in FIG. 3A, the chain 62 contacts the base 32 and continued deployment leads to a portion 36 of the chain 62 coming to rest on the base, as shown in FIG. 3B. A second portion 37 of the chain 62 is not resting on the base 32 of the control chain tower is suspended within the control tower. This weight is supported from the marine vessel, and thus is relevant to the coupling of the apparatus 10 with the marine vessel. The portion 37 of chain helps to resist lateral forces on the apparatus 10 due to currents. A lateral force on the apparatus 10 tends to move the apparatus with respect to the chain 62 and the control vessel 60, as shown in FIG. 3C. However, the lateral force must overcome the resistance due to weight of the suspended portion 37 in the chain tower 30: in order to move the apparatus with respect to the control vessel and control chains, the lateral force must overcome the frictional contact between the control chain 62 and the inside surface of the control chain tower 30, and be sufficient to lift additional chain 62 from the chain locker at the base of the control chain tower. A third portion 38 of the chain is suspended above the tower, the weight of which is also supported by the control vessel 60. This portion 38 of the chain contributes to the lateral control of the vessel, by providing the effect of a catenary clump weight coupled between the opening of the chain tower 30 and the control vessel 60. The control chain tower therefore provides resistance to lateral forces due to current, and helps retain the position of the apparatus beneath the control vessel 60.

By providing multiple control chain towers 30, a greater resistance to lateral forces is provided. In addition, the spatially separated control chain towers provide the facility to adjust the trim of the apparatus. Resistance against rotational movement is also provided. Stability of the apparatus 10 is improved by separating the control chain towers 30 over as wide an area as possible.

The control chains 62 may be of any size and length as required for the operation. Different sizes and lengths of control chains may be used in different operations, in dependence on environmental conditions, working depth, and expected currents. The unit weight (weight per meter) of the chains is chosen to ensure that the natural period of the system is significantly different from the predominant wave periods. This ensures that the dynamic response of the apparatus and payload is significantly less than that of the control vessel.

The apparatus will now be described in various modes of operation.

Figure 4:
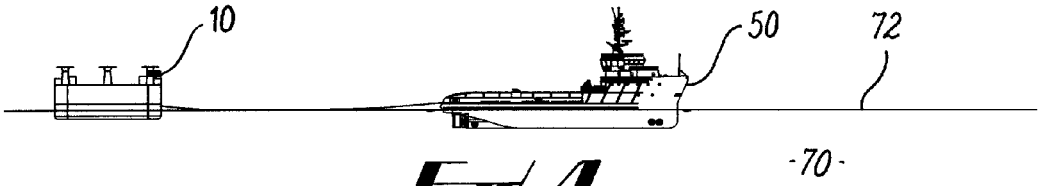
FIG. 4 is a schematic side view of the apparatus in a surface tow configuration in accordance with an embodiment of the invention.

FIG. 4 shows the apparatus 10 connected to a tug boat 50 in a surface tow configuration in the water 70. The hulls 12, 14 are completely de-ballasted and no trimming chains or payload are provided on the apparatus 10. Where the payload is of a suitable size and/or weight, it may be loaded into the apparatus 10 from above, through the space 20. A mechanical interface (not shown) is used to connect the payload to the apparatus. Such an initial loading procedure may be performed by an auxiliary crane vessel near shore in sheltered waters or by an onshore crane facility. Loading may also be performed in a fixed or floating dry dock. In the configuration shown in FIG. 4, the apparatus 10 may be transported on the surface 72 in the way of a conventional barge.

Where the payload is not suitable for loading from above the apparatus 10, it may be placed on to the seabed, for example in sheltered waters near shore. The apparatus 10 is then manoeuvred over the payload, which is connected to the apparatus 10 via the interface. To assist with this operation, the tanks of the apparatus 10 can be fully or partially ballasted in order to place the apparatus 10 in range to connect the payload to the apparatus via the interface.

Although in FIG. 4, the apparatus 10 is shown without a payload, it could equally be transported at or near the surface of the water with shallow draught with the payload 40 attached. The draught of the apparatus 10 is controlled predominately by the flooding of the tanks, rather than the weight of the payload.

Figure 5:
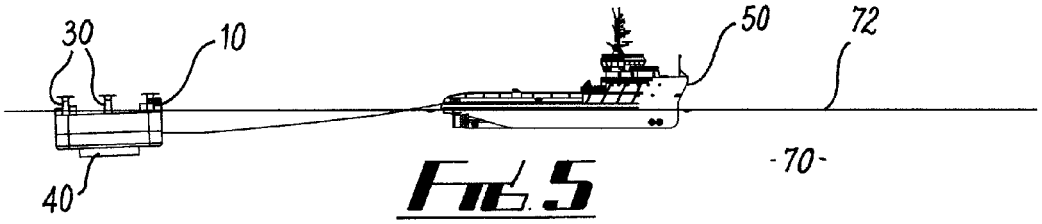
FIG. 5 is a schematic side view of a combined apparatus and payload assembly in a surface tow configuration in accordance with an embodiment of the invention.

FIG. 5 shows the apparatus 10 with the payload 40. The apparatus is shown fully flooded with only the upper most parts of the apparatus above the surface 72 of the water 70. These are the fore and aft castles 24 with the predetermined spare buoyancy, upper parts of the control chain towers 30, and the work platform 26. The draught is determined on all four castles 24 of the apparatus 10 to confirm the appropriate trim and list of the apparatus. The trim can be adjusted by ballast chain in the chain lockers 28. The apparatus is configured to have a slight aft trim to compensate for the weight distribution when the tow chain clump 58 is added. At this time, the tow chain clump weight 58 is selected to ensure that the apparatus can be weighed down by the clump weight 58, and that there is sufficient spare weight in the chain clump to anchor the apparatus 10 on the seabed against lateral currents.

Figure 6A:
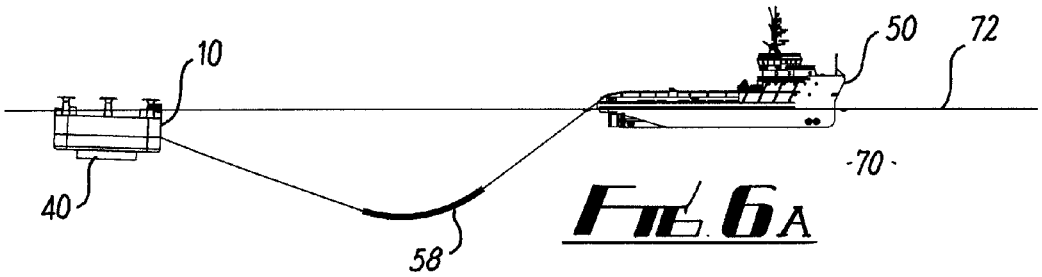
FIGS. 6A, 6B and 6C are schematic side views of a submerged tow system at different stages of a towing operation in accordance with an embodiment of the invention.
Figure 6B:
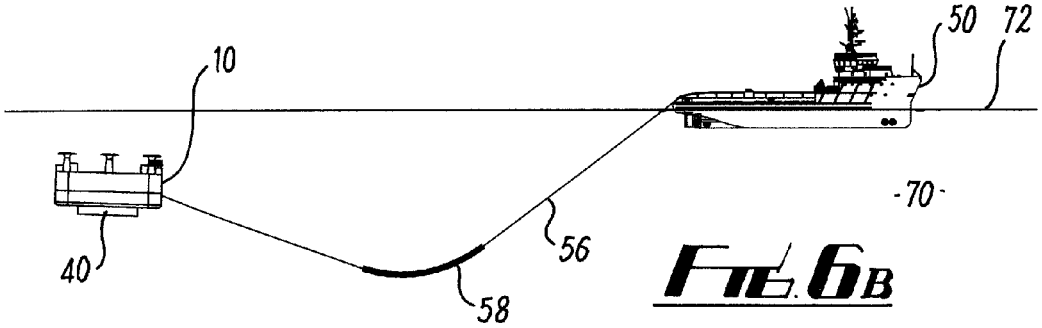
Figure 6C:
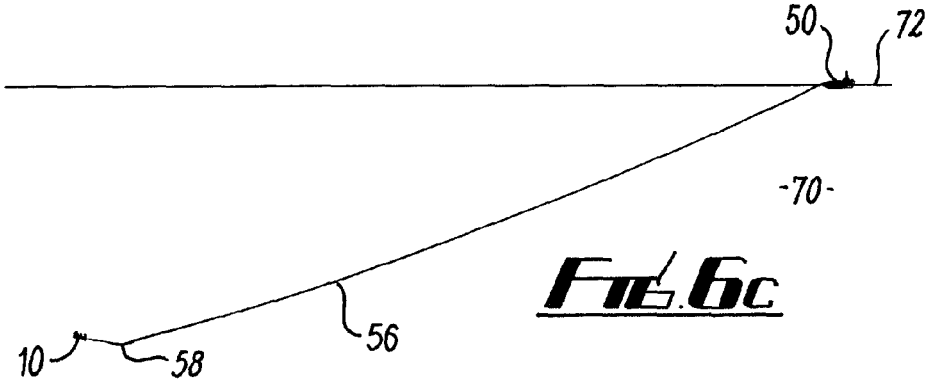

FIG. 6A shows the apparatus 10 in a partially submerged tow condition. The tow chain clump 58 has been deployed and connects the tow pennant 54 with the tug tow line 56. A part of the weight of the tow chain clump 58 is carried by the apparatus 10, and creates a slight forward trim condition of the apparatus. The position and effect of the tow chain clump 58 on the apparatus is dependent on the length and the tension in the tow line. As the tow line 56 is paid out by the tug boat, the apparatus and payload assembly is submerged deeper in the body of water, as shown in FIG. 6B. FIG. 6C shows the tow line 56 paid out to a significant distance, with a tow speed which maintains tension in the tow system to position the apparatus at an appropriate depth.

Figure 7:
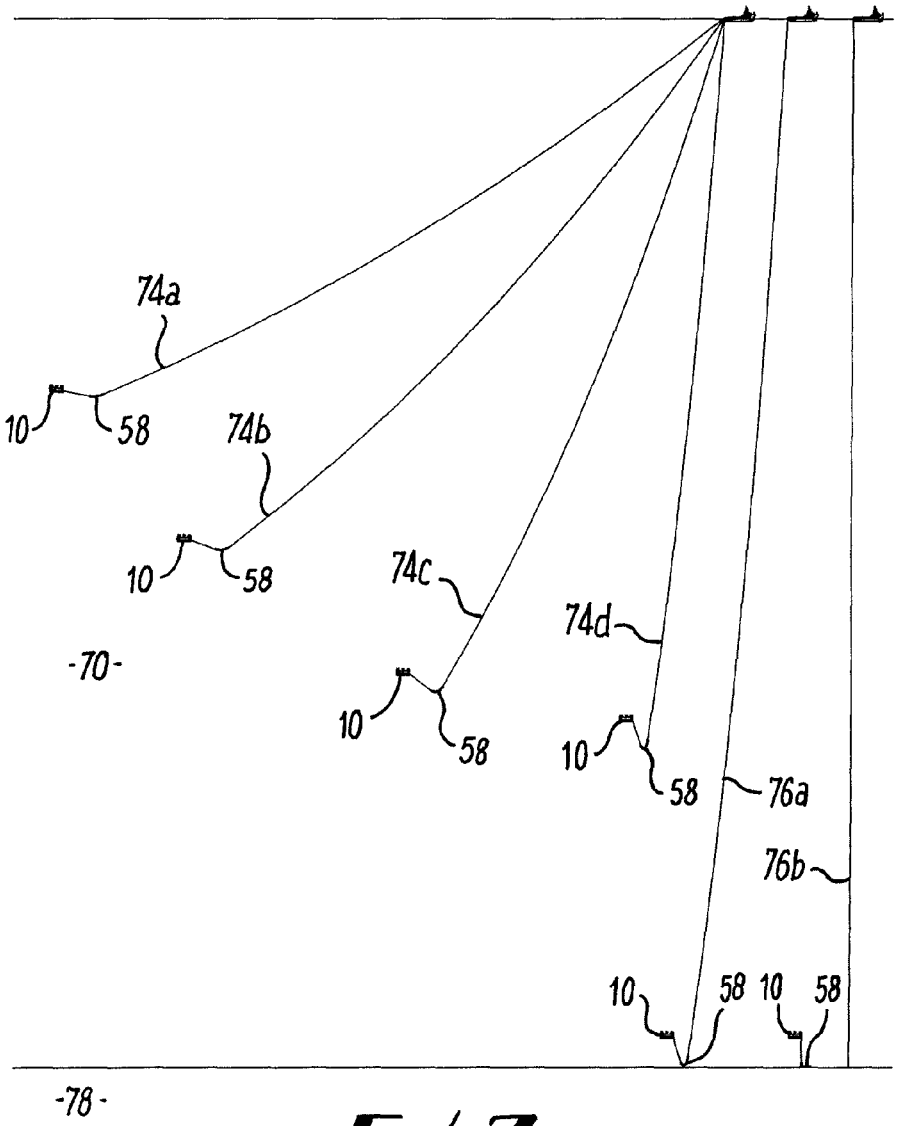
FIG. 7 is a schematic view showing sequentially different stages of a submerged tow and parking operation in accordance with an embodiment of the invention.

FIG. 7 shows the position of the apparatus 10 and tow line 56 with different towing parameters. Lines 74*a* to 74*d* show the position of the apparatus in relation to the tug boat with a constant length of tow line, but with sequentially decreasing tension in the line. As the tension of the line decreases, the apparatus moves laterally closer to the position of the tug boat at surface, and increases in depth in the water. Lines 76*a* and 76*b* show the system with the tow line paid out still further, until the clump weight 58 and a portion of the tow line rests on the seabed 78.

The submerged tow method allows the apparatus to be towed without being subject to adverse conditions at the surface 72. The tow speed and length of the tow wire 56 can be adjusted to raise or lower the apparatus 10 according to the weather conditions. For example, the tow speed can be reduced to lower the apparatus 10 and reduce snatch loads applied to the tow system by the tug boat 50. The towing chain clump 58 has the effect of significantly dampening the snatch loads to reduce their impact on the apparatus 10. The apparatus 10 is provided with positional and navigational equipment (not shown) such as gyroscopes and motion sensors which allow monitoring of the apparatus throughout the towing process. Transponders on the apparatus allow communication with the tug boat 50, the control vessel 60 and/or other control centres at surface.

Figure 8A:
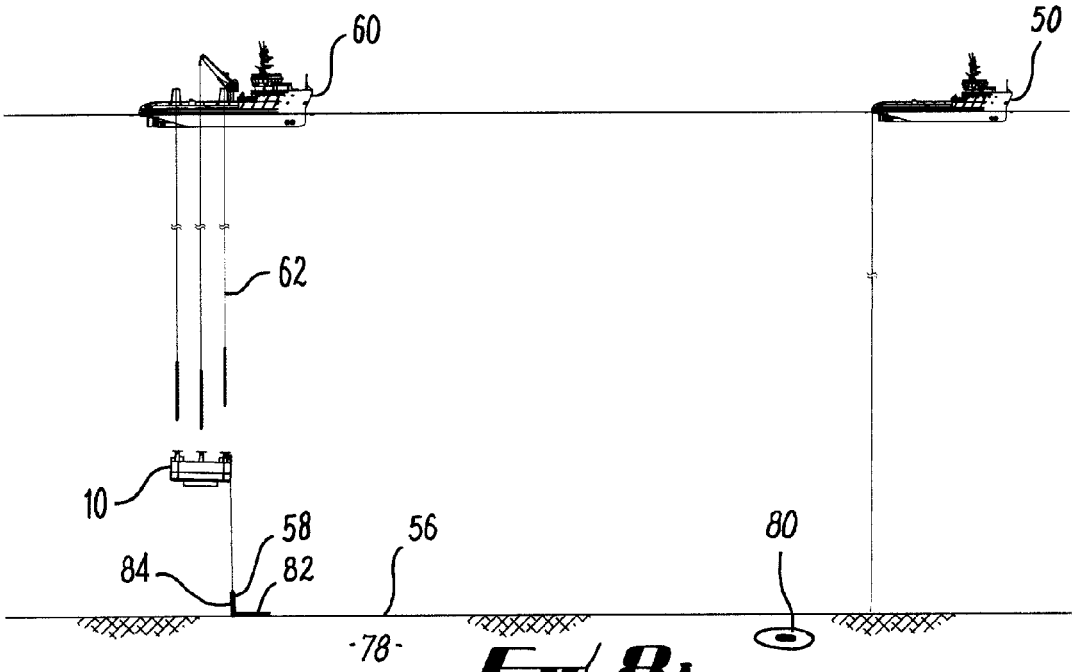
FIGS. 8A and 8B show stages of an installation operation using a control vessel in accordance with an embodiment of the invention.

FIG. 8A shows schematically the installation system 100 in the position indicated by reference numeral 76*b* in FIG. 7 at a different scale and with control vessel 60 in attendance. The apparatus 10 is in a submerged position floating above the seabed 78 in the vicinity of the landing target 80. A portion 82 of the tow chain clump 58 proximal to the tow line 56 rests on the seabed. A portion 84 of the tow chain clump 58 proximal to the apparatus 10 is lifted from the seabed 78, due to the excess positive buoyancy of the apparatus 10. The weight of the portion 84 of the tow chain clump lifted from the seabed corresponds to the surplus buoyancy of the apparatus and payload assembly. The portion 82 of the tow chain clump which rests on the seabed serves to anchor the assembly. The weight of the portion 82 provides drag resistance against currents acting on the assembly and which may otherwise tend to move the apparatus.

The control vessel 60 has begun to deploy the control chains 62, although in FIG. 8A there are not coupled to the apparatus 10. One function of the control chains 62 is to overcome the surplus buoyancy in the apparatus to allow the apparatus and payload assembly to be lowered to the seabed 78. The control chains 62 must therefore have sufficient weight to overcome the buoyancy, which will be the same weight of the portion 84 of the tow chain clump that is lifted from the seabed by the apparatus.

An additional function of the control chains 62 is to resist lateral or rotational movement of the apparatus 10 due to currents. The control chain 62 is therefore made sufficient in length to allow it to rest on the apparatus to overcome the weight of the surplus buoyancy, but also to extend upward through the control chain tower 30 such that the control chain 62 extends out of the opening of the control chain tower. Lateral forces on the apparatus will tend to splay out the control chain, which will be resisted by the frictional contact between the control chain and the inner surface of the control chain tower 30, and by the weight of the chain that is suspended in the control chain tower 30.

The control chains 62 are lowered to the apparatus 10 until they are received in the receptacles which are formed by the control chain towers 30. The control chains are deployed until the buoyancy of the apparatus and payload assembly is neutralised. When this occurs, the tow chain clump 58 is no longer lifted from the seabed, and rests on the seabed as shown in FIG. 8B.

Figure 8B:
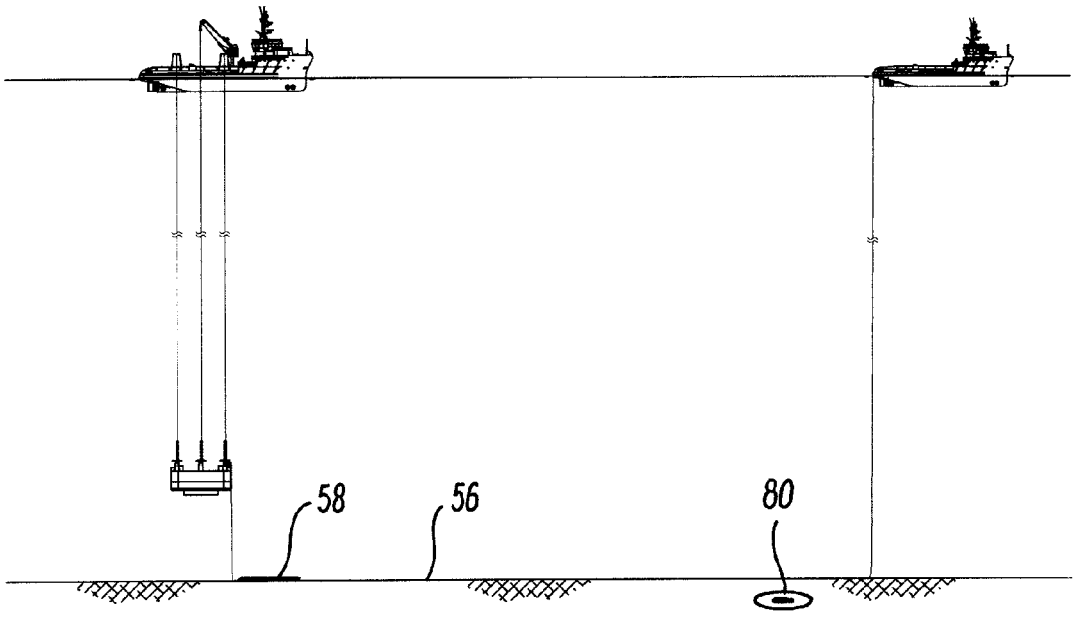

In the configuration of FIG. 8B, the system is stable, with the vertical position of the apparatus and payload assembly controlled by the control vessel via coupling with the control chain lines. Lateral positional control is by the control chain system, in particular by virtue of the vertically suspended portion of the control chain in the control chain towers, and supplemented by the anchoring by the tow chain clump 58. To further improve the rotational and/or lateral stability of the apparatus and payload assembly, one or more of the control chains 62 may be laterally repositioned at surface. This has the effect of splaying out the control chain at the point of entry of a control chain tower.

In FIGS. 8A and 8B, the system is shown with the tug boat 50 connected to the apparatus via the tow system and clump weight 58. This may be useful to provide additional stability and/or heading control to the system, but is not necessary in all implementations. For example, in another implementation, the tug boat 50 may disconnect from the tow chain clump 58 if the tug boat is required for other operations, or in adverse weather conditions in the vicinity of the installation which the tug boat may not be capable of withstanding. It will be appreciated that the configuration shown in FIG. 8A allows the apparatus and payload assembly to be left floating suspended above the seabed in a safe condition, with the tug boat disconnected or paying out a significant length of tow line to attend other marine sites. If the tug has been disconnected, the chain clump 58 can be disconnected from the apparatus prior to moving the apparatus to its target position (as described below). Alternatively the length of the line between the chain clump 58 and the bridle may be sufficient to allow the apparatus 10 to move to its target position without disconnecting the clump weight from the apparatus.

Figure 9C:
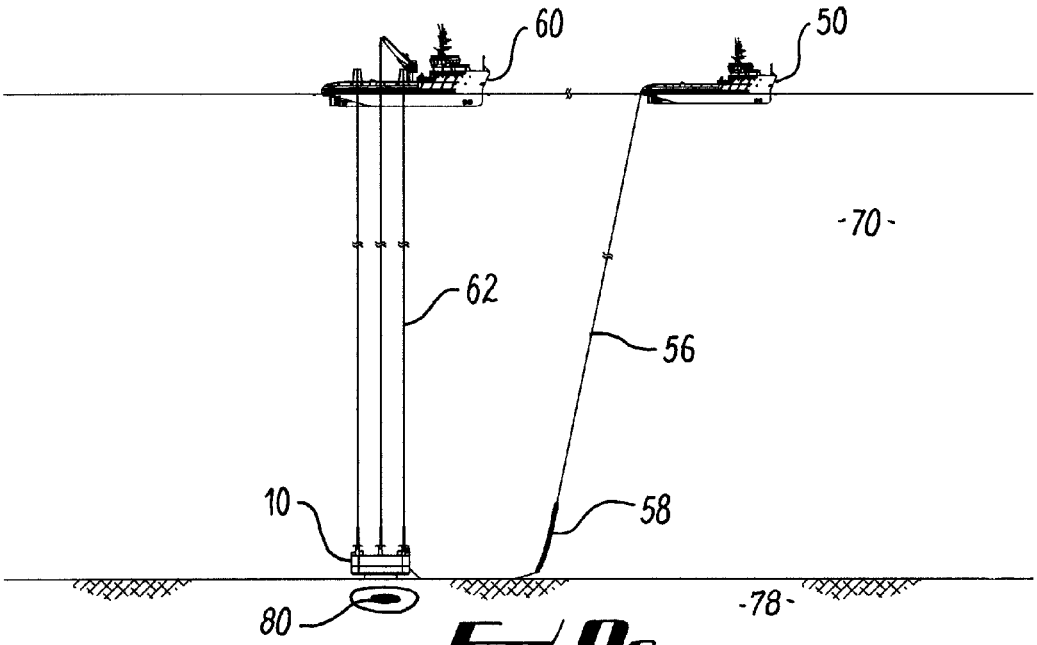

FIGS. 9A to 9C show the repositioning and landing of the apparatus and payload assembly under the control of the control vessel 60. In FIG. 9A, the tug boat 50 draws in the tow line 56 until it is lifted from the seabed. Because the tow chain clump 58 is in FIG. 8B and FIG. 9A not contributing to the weight of the apparatus, it has no effect on the vertical positional control of the apparatus, and the towing chain clump is lifted from the seabed 78 such that in FIG. 9B, the apparatus is under the full control of the control vessel 60. The control vessel 60 may adjust the payouts of one or more control chains 62 individually in order to adjust the trim and list of the apparatus 10. The control vessel 60 moves towards the target landing location 80, and the lateral control provided by the control chains 62 moves the apparatus 10 in position below the control vessel. In FIG. 9B, the tug boat and tow system remains attached. This may provide the operation with additional stability and security, although it will be appreciated that the tug boat 50, tow line 56 and tow chain clump 58 could be detached from the apparatus while the control vessel moves the apparatus and payload assembly into the required position.

When the apparatus and payload assembly is in the required location above the target 80, it is lowered to the seabed 78 by paying out each control chain 62 at the same rate. This overcomes the buoyancy in the apparatus and lowers the apparatus to the seabed, as shown in FIG. 9C. At the same time, the tow line (if attached) is paid out at the same rate to maintain slack between the tow chain clump and the apparatus. When the apparatus and payload assembly is landed on the seabed in the intended position, the control chains 62 are completely lowered to provide their full weight on to the assembly and retain it on the seabed.

Figure 10A:
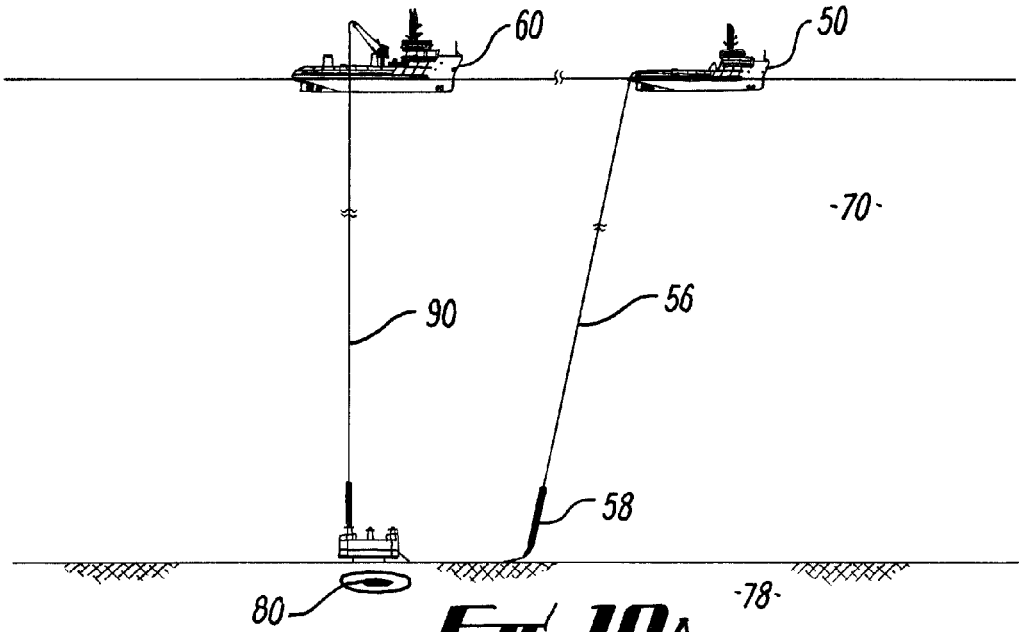
FIGS. 10A, 10B, 10C, 10D and 10E are schematic side views of a load installation operation in accordance with an embodiment of the invention.

In FIG. 10A, the control chains 62 have been detached from the control vessel 60, and rest on the apparatus 10. It should be noted that in this configuration, the net buoyancy of the apparatus is still positive, and it is the weight of the payload 40 which retains the apparatus and payload assembly on the seabed. The apparatus 10 therefore poses no load on to the payload 40.

Figure 10B:
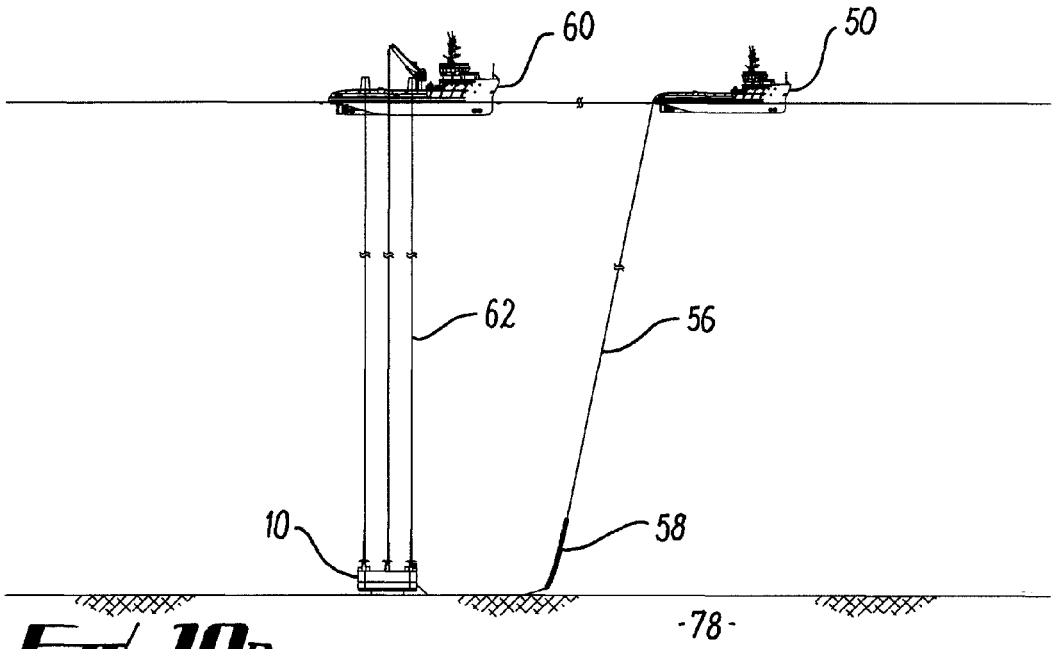

The next stage in the operation is the deployment of one or more ballast chains 90 to the assembly on the seabed. The ballast chains 90 are lowered from the control vessel into the ballast chain lockers 28. Ballast chains 90 are deployed to a weight equivalent to the weight of the payload 40. When all ballast chains have been added to the ballast chain lockers 28, the apparatus 10 imparts a load on to the payload 40 which is equivalent to the surplus weight of the control chains. The interface between the payload 40 and the apparatus 10 is therefore not under a tensile load, which allows an ROV (not shown) to disconnect the apparatus 10 from the payload 40. With the payload 40 disconnected, the control chains 62 are reconnected to the control vessel 60, as shown in FIG. 10B. The control chains 62 are then slowly recovered to reduce their weight on the apparatus 10, until the apparatus becomes neutrally buoyant and floats away from the payload, as shown in FIG. 100.

Figure 10C:
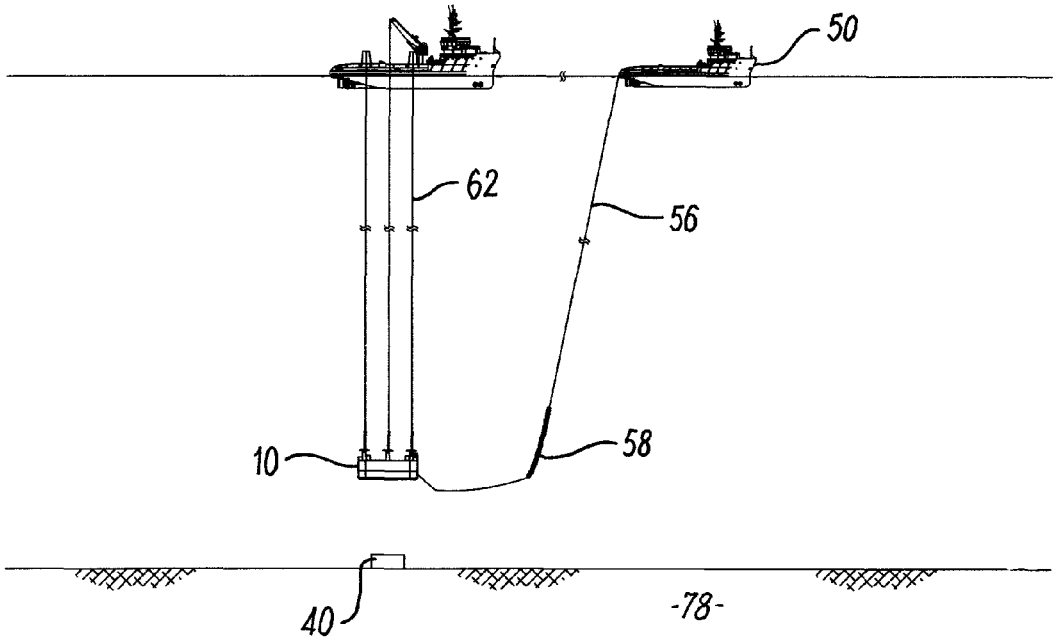
Figure 10D:
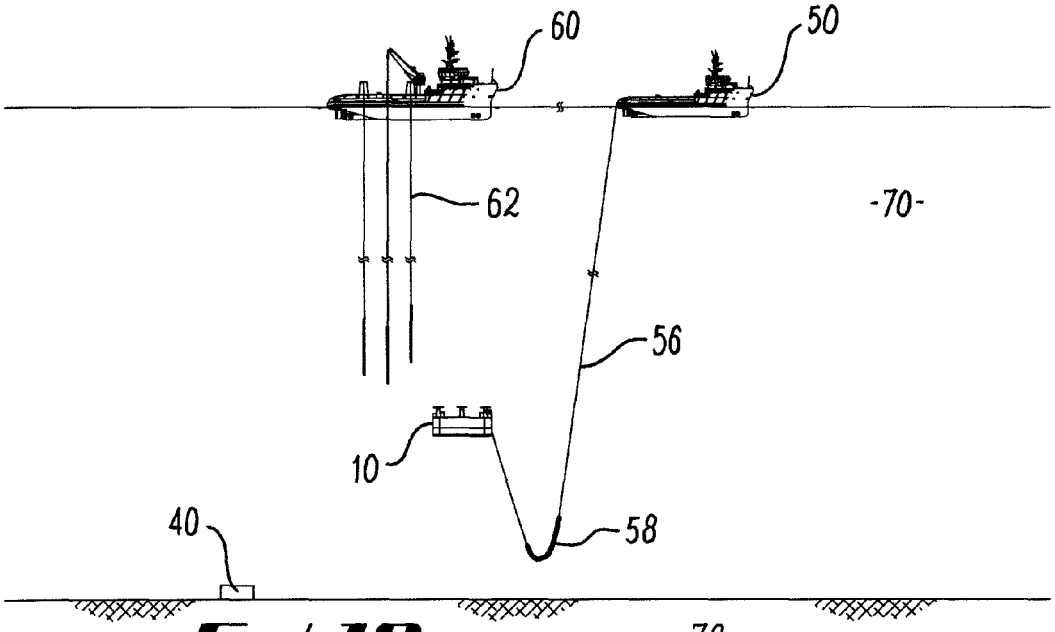

In the configuration shown in FIG. 10C, the control vessel may translate to a lateral position clear of the payload 40 and any surrounding subsea infrastructure. The control chains 62 continue to be recovered until the apparatus 10 raises to a position in which there is tension between the apparatus 10 and the tow chain clump 58 via the tow bridle and tow pennant, as shown in FIG. 10D. At this point, the tow chain clump 58 has the effect of overcoming surplus buoyancy in the apparatus 10, and the control chains can be completely decoupled from the apparatus 10.

Figure 10E:
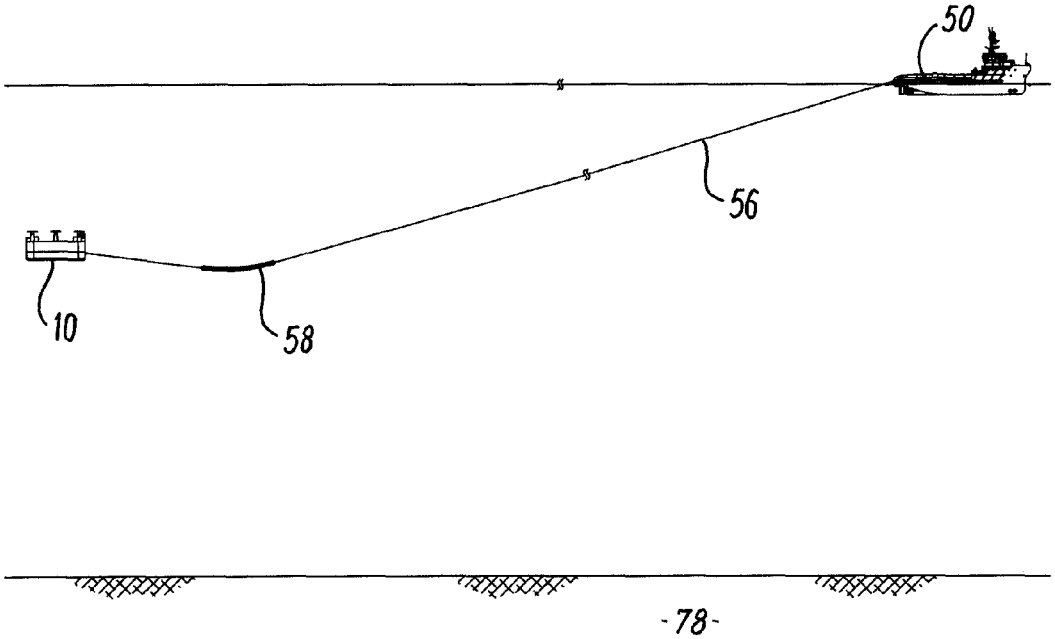

FIG. 10E shows the apparatus 10 being towed away by the tug boat 50, with vertical position control by means of the clump weight 58 and the tow speed and tow line distance parameters, as described with reference to FIGS. 6 and 7. When the apparatus is returned to shore, in the configuration as shown in FIG. 5, it is de-ballasted by closing the vent valves of the ballast tanks, and using a compressor to displace water from the tanks in the hulls 12 and 14.

The foregoing description relates to an apparatus and method for lowering a payload to the bed of a body of water. It will be appreciated that the principles of the invention may be used in a method of recovering or raising a subsea item. In particular, the steps of the example methodology, or a subset thereof, may be reversed. For example, the apparatus comprising a ballast chain may be lowered into position over a payload on the seabed by lowering control chains from a control vessel. The apparatus may be coupled to the payload via an interface, and the ballast chain may be retrieved to surface. Subsequently, the control chains may be gradually retrieved to raise the apparatus and payload assembly above the seabed until the surplus buoyancy of the apparatus is made neutral by the tow chain clump weight, and the combined apparatus and payload assembly may be subject to a submerged tow by the tug boat to an alternative offshore or onshore location. By performing the steps of the above described method (or selected steps thereof) in reverse, the advantages described with reference to the lowering of a load are experienced in a retrieval operation.

In an alternative embodiment of the invention, the apparatus is designed to form an integral part of the structure which is to be lowered subsea. In other words, the features of the apparatus are included into the payload itself. Such an embodiment is fabricated with positive buoyancy, such that the centre of buoyancy is located above the centre of gravity. It is advantageous to provide buoyancy by floodable structures which are charged with inert gas at pressure to resist compression due to the hydrostatic forces experienced at significant depths. In this configuration, the application of the apparatus will be limited by the pressure rating that can be pre-charged to the structure.

The described embodiment includes three control chain towers, although it will be appreciated that a different number of control chain towers could be provided. In a simple embodiment, a single control chain tower may be provided. However, multiple control chain towers are preferred to provide trim and list control and resistance against rotation of the apparatus. Three or more controlled chain towers are preferred, and may be configured in any shape. Advantageously, the control chain towers will be laterally separated from one another to provide maximum sensitivity.

In an un-illustrated embodiment, one or more control chain towers is provided by a recoverable tower extension. This offers advantages where the size and/or shape of the structure do not allow a suitable height of permanent control chain tower to be used.

An alternative embodiment of the invention differs from the embodiment described above in that the ballast used to compensate for the weight of a payload is not deployed from and/or recovered to the surface. For example, the apparatus could be configured to pick-up or otherwise take on ballast at the seabed. In one embodiment, the ballast weight could be provided on the seabed at or adjacent the landing location of the payload. The apparatus may be configured to take the ballast at the seabed and release the payload. The combined apparatus and ballast can then be recovered to surface in the manner described above. Similarly, in a method of raising a payload, the apparatus could be provided with ballast (for example rock) which is released to the seabed after the apparatus is coupled to the payload.

To facilitate these modes of operation, the apparatus may be provided with a ballast chamber or ballast receptacle. It may also be configured to allow it to be coupled to ballast weights specially positioned relative to the payload, such that a payload and ballast can be simultaneously attached or detached from the vessel. Alternatively or in addition, the apparatus may be configured for the attachment of two payloads.

Such embodiments allow the system to be conveniently used as a shuttle for moving items of subsea infrastructure between a subsea location and shore. For example, the method may be used to transfer modules of a larger subsea structure to a shore location for maintenance or modification, with subsea ballast weights being used to ballast the apparatus when a load is not attached. In such a method of operation, the ballast weights will be transferred between the respective locations in the opposite sense. In another mode of operation the apparatus could be used to exchange payloads at a subsea location. A first payload may provide the effect of the ballast on the tow out, and a second payload may provide the effect of the ballast on the inward tow. Such a system may be particularly suitable for the change out of modular components of a larger subsea structure.

The ballast weight may comprise for example a chain or may comprise one or more discrete weights or rocks. Alternatively, the ballast may be provided by taking on a heavy slurry or fluid into tanks or other receptacles located in the apparatus. The ballast fluid or slurry may be pumped into the receptacles, for example from surface, or may be taken on by flooding receptacles or tanks with seawater. In other embodiments, combinations of ballast weight in articulated, discrete, or fluid form may be used.

In one alternative embodiment, at least one of the control chains 62 is secured to the apparatus 10 by a hold back line (not shown). The hold back line is sufficiently strong to resist forces due to current surges. The hold back line should be sufficiently weak such that it will not overload the crane if snatch forces are experienced by the apparatus. If provided, the holdback line is disconnected during the recovery of the control chains to the deck of the control vessel 60, so that the control chains can be completely decoupled from the apparatus.

The interface between the apparatus and the payload may for example comprise a rigid mechanical connection and/or an arrangement of slings. In the latter case the payload may be detached from the apparatus by cutting through the slings using an ROV.

The apparatus 10 comprises two transverse members, although it will be appreciated that alternative embodiments may include a different number. This may be desirable or necessary where the apparatus has hulls or pontoons which are large, for example, where the apparatus is configured for the installation of particularly large structures.

In a variation to the above-described embodiments, a single vessel functions as the towing vessel and the control vessel. The control vessel may be configured to lower the control chains using winches on the vessel rather than cranes as used in the embodiment described above.

Embodiments of the present invention deliver several advantages over the installation and deployment systems described in the prior art.

One specific advantage of the present invention is that the methods of use, for example installation or retrieval of subsea components, have in built contingency. This provides an important safety improvement when compared to previously available systems.

In particular, the method can be interrupted at any time and the surface vessels may be subsequently moved from the location of the apparatus. For example, if during the subsea tow, conditions become severe and the tug vessel needs to relocate to calmer seas, the apparatus and the towing system can be detached and the apparatus is left safely floating above the seabed, anchored by the clump weight 58. Alternatively or in addition, the control vessel can be moved to a different offshore location by recovering the control chains from the apparatus.

Similarly, the tug vessel can be mobilised to a different location (complete with towing system and clump weight if required) when the control vessel has control of the apparatus, as shown in FIG. 9B. In all of the above scenarios, the apparatus is left safely floating above the seabed with lateral control. It will also be appreciated that if required the control vessel and/or tug boat can be moved during stages of the operation when the control chains have been fully deployed into the apparatus and the apparatus rests on the seabed.

The methodology has no need for a large crane vessel, with the capacity of the control vessel only required to deal with the control chain and ballasted chain systems.

In various aspects, the present invention reduces or obviates the need for onshore lifting of a payload. In addition, the transition of the payload through the water surface may be performed in shore or near shore in sheltered water.

The submerged tow system has reduced sensitivity to weather when compared with the prior art systems. The lowering operation using the control chains has reduced sensitivity to weather conditions at the surface.

Hydrodynamic loading on the payload is significantly reduced when compared with the prior art systems. Significant vertical movement of the control vessel results in small variations in the down line tension, because the hydrodynamic loading on the chain is small. Since the control chains rest on or within the apparatus, and are not directly coupled, there is no hydrodynamic loading transferred on the down line to the apparatus.

The relationship between the mass of the apparatus and the payload and the weight of the chain per meter will ensure that there is little response of the apparatus due to cyclical motion of the chains with vessel movement. In other words, the system provides a heave compensation mechanism without the need for sophisticated active heave compensation technology. Indeed, in general the equipment and technology required for implementation of the invention is simple and reliable.

By using solid buoyancy and the flooding of all buoyancy tanks before lowering the structure to depth avoids the possibility of hydrostatic collapse.

The apparatus and method of the invention may be used with very large and heavy structures in deep water installations, using low cost vessels. The system is capable of handling loads of any weight, limited only by the size of the buoyancy. For example, embodiments of the invention may be used to lift weights up to several thousand tonnes without the use of a heavy lift vessel.

The process of landing the payload can be performed in a highly controlled manner. The weight of the control chains is small in relation to the weight of the apparatus and payload, and therefore a fine degree of control can be achieved to ensure a soft landing on the seabed.

There is provided a method and apparatus for lowering and/or raising a load or structure to or from the bed of a body of water. The apparatus comprises a buoyancy apparatus configured to be coupled to a load, and having positive buoyancy sufficient to lift the load. At least one receptacle is provided on the apparatus for receiving a control weight lowered from a vessel to lower or raise the assembly. The lowering method includes forming an assembly from a buoyancy apparatus and a load and submerging the assembly to a position at a first height above the bed. In a preferred embodiment the assembly is submerged by a clump weight tow system. A control weight is deployed from a vessel to the assembly to overcome the positive buoyancy of the assembly and thereby lower the load from the first height to the bed. The raising method reverses the steps of the lowering method.

Variations to the above-described embodiments are within the scope of the invention, and the invention extends to combinations of features other than those specifically claimed herein.

The invention claimed is:

1. A method of lowering a load to a bed of a body of water, the method comprising:

providing an assembly formed from a buoyancy apparatus coupled to a payload, wherein the buoyancy apparatus renders the assembly positively buoyant;

submerging the assembly to a position at a first height above the bed;

deploying a control weight from a vessel to the assembly to overcome the positive buoyancy of the assembly and thereby lower the payload from the first height to the bed and detaching the payload from the buoyancy apparatus at the bed of the body of water.

2. The method as claimed in claim 1 comprising submerging the assembly to the first height above the bed using a clump weight line.

3. The method as claimed in claim 2 comprising parking the assembly at the first height with the assembly anchored by the clump weight line.

4. The method as claimed in claim 3 comprising coupling the control weight to the assembly at the first height above the bed.

5. The method as claimed in claim 3 wherein the control weight is a control chain.

6. The method as claimed in claim 1 comprising coupling the control weight to the assembly at the first height above the bed.

7. The method as claimed in claim 6 comprising receiving the control weight in a receptacle on the buoyancy apparatus.

8. The method as claimed in claim 7 wherein the control weight is a control chain.

9. The method as claimed in claim 7 comprising deploying multiple control weights from the vessel to the assembly.

10. The method as claimed in claim 7 comprising ballasting the assembly with a ballast weight corresponding to the weight of the payload of the assembly; and subsequently detaching the payload from the buoyancy apparatus at the bed of the body of water.

11. The method as claimed in claim 6 wherein the control weight is a control chain.

12. The method as claimed in claim 6 comprising deploying multiple control weights from the vessel to the assembly.

13. The method as claimed in claim 6 comprising ballasting the assembly with a ballast weight corresponding to the weight of the payload of the assembly; and subsequently detaching the payload from the buoyancy apparatus at the bed of the body of water.

14. The method as claimed in claim 1 wherein the control weight is a control chain.

15. The method as claimed in claim 14 wherein the method further comprises:

supporting a first portion of the control chain on a lower surface of a receptacle of the apparatus;

suspending a second portion of the control chain above the first portion within the receptacle; and suspending a third portion of the control chain between the control vessel and an opening to the receptacle.

16. The method as claimed in claim 14 comprising deploying multiple control weights from the vessel to the assembly.

17. The method as claimed in claim 14 comprising ballasting the assembly with a ballast weight corresponding to the weight of the payload of the assembly; and subsequently detaching the payload from the buoyancy apparatus at the bed of the body of water.

18. The method as claimed in claim 1 comprising deploying multiple control weights from the vessel to the assembly.

19. The method as claimed in claim 18 comprising ballasting the assembly with a ballast weight corresponding to the weight of the payload of the assembly; and subsequently detaching the payload from the buoyancy apparatus at the bed of the body of water.

20. The method as claimed in claim 1 comprising ballasting the assembly with a ballast weight corresponding to the weight of the payload of the assembly; and subsequently detaching the payload from the buoyancy apparatus at the bed of the body of water.

21. The method as claimed in claim 20 wherein the ballast weight comprises:

a ballast chain;

one or more discrete weights; and a fluid or slurry taken on by the assembly.

* * * * *

UNITED STATES PATENT AND TRADEMARK OFFICE

CERTIFICATE OF CORRECTION

PATENT NO. : 8,992,127 B2
APPLICATION NO. : 13/061691
DATED : March 31, 2015
INVENTOR(S) : Joensen et al.

It is certified that error appears in the above-identified patent and that said Letters Patent is hereby corrected as shown below:

In the Specification

Column 8
Line 22, change "tow wire" to --tow line--

Column 11
Line 18, change "there are" to --they are--

Column 12
Line 65, change "FIG. 100" to --FIG. 10C--

Signed and Sealed this
Fifteenth Day of March, 2016

Michelle K. Lee

Michelle K. Lee
*Director of the United States Patent and Trademark Office*